United States Patent [19]

Gay

[11] Patent Number: 4,591,106

[45] Date of Patent: May 27, 1986

[54] AUTOMATIC DOFFING METHOD

[76] Inventor: Benjamin A. Gay, P.O. Box 2683, Spartanburg, S.C. 29394

[21] Appl. No.: 734,658

[22] Filed: May 16, 1985

[51] Int. Cl.[4] ..... B65H 67/04

[52] U.S. Cl. ..... 242/18 G; 57/274; 57/275; 242/35.5 A; 242/41

[58] Field of Search ..... 242/18 G, 18 R, 35.5 A, 242/35.5 R, 41; 57/275, 274

[56] References Cited

U.S. PATENT DOCUMENTS

| | | | |
|---|---|---|---|
| 3,881,603 | 5/1975 | Stotler et al. | 242/35.5 A X |
| 3,964,723 | 6/1976 | Schippers et al. | 242/35.5 A |
| 3,974,973 | 8/1976 | Lenk et al. | 242/41 |
| 4,007,882 | 2/1977 | Isoard | 242/35.5 A X |
| 4,022,392 | 5/1977 | Thomas, Jr. et al. | 242/41 |
| 4,023,743 | 5/1977 | Schippers | 242/35.5 A |
| 4,226,567 | 10/1980 | Van Orsdale, Jr. | 242/35.5 A X |
| 4,309,000 | 1/1982 | Schefer et al. | 242/35.5 A X |
| 4,427,158 | 1/1984 | Conrad | 242/35.5 A |
| 4,555,067 | 11/1985 | Angelucci et al. | 242/35.5 A |

FOREIGN PATENT DOCUMENTS

| | | | |
|---|---|---|---|
| 110275 | 6/1984 | European Pat. Off. | 242/35.5 A |
| 92873 | 5/1984 | Japan | 242/35.5 A |
| 2152084 | 7/1985 | United Kingdom | 242/35.5 A |

*Primary Examiner*—Stanley N. Gilreath
*Attorney, Agent, or Firm*—Cort Flint

[57] ABSTRACT

A method is disclosed for automatically doffing a full strand package on a collet winder such as used in the manufacturing of fiberglass and the like strands. The method includes providing a rotating doffing cup (A) which includes a cylindrical cup (40) having an inflatable liner (44) carried on the inside of the cup. A robotic vehicle (10) includes a servo-linkage arm (28) which positions the doffing cup at a desired winding station along a row (14) of collet winders (B). The method includes bringing the doffing cup up to an approach position, pivoting a traverse guide (76) away from the collet, and extending the doffing cup over a full strand package (36). The rotating cup is brought up to a speed slightly greated than the speed of the rotating yarn package. The liner (44) is then inflated causing the rotating doffing cup to grip the strand. The rotating cup (A) is then retracted with the strand package. A length of strand (90) extends from the doffed yarn package (91) to auxiliary windings (88) formed on the collet from the strand (74) being previously pushed off the strand package. During retraction, the strand (90) breaks. The doffed strand package is then placed on a carrier (34) at a receiver station (32) which conveys the full strand packages to a next processing station.

18 Claims, 5 Drawing Figures

AUTOMATIC DOFFING METHOD

BACKGROUND OF THE INVENTION

The invention relates to the automatic doffing of a strand package which has been formed on a rotating collet and the like wherein a full strand package is doffed from the collet while rotating.

In the manufacture of wound strand packages in which a continuous strand of fibers is advanced to a rotating collet to form a strand package thereon, the problem occurs of removing the strand package once it has become full, while not interfering with the continuous strand-forming process. In the production of synthetic strands, the individual fibers comprising the strand come from an extrusion machine or furnace in which the multiple filaments are extruded continuously through spinneretts or bushings. The process is continuous, and the winding of the filaments in the form of a single strand to form a package cannot occur intermittently without the production of waste or inferior quality strands. In particular, fiberglass production requires continuous furnace operation and winding at higher speeds than other synthetics resulting in more waste during doffing of full packages and starting of new packages.

Heretofore, numerous techniques have been utilized for moving a full package of a continuous strand wound upon a tube or other carrier, ranging from manual doffing to automatic mechanical doffing. Automatic doffing devices are disclosed in U.S. Pat. Nos. 3,908,918 and 4,138,072. These patents disclose means for ejecting the full strand package from the winder by utilizing some mechanical means for pushing the package off of a spindle while in a stationary position.

It is also been known to utilize a pneumatic gripper for doffing a bobbin from a spindle overhead when stationary such as shown in U.S. Pat. Nos. 4,472,934 and 2,952,113. While these devices disclose the use of a pneumatic gripper, the methods and apparatus are suitable only for doffing a stationary package from a stationary doffer in a very limited motion.

It has also been known in the manufacture of continuous strands of glass fibers to utilize turret winders so that the continuous production of the strand is not interrupted when stopping the winder to doff the strand package. However, utilization of the turret type winder complicates the strand production process considerably owing to the more complex and space consuming nature of the turret winder.

Accordingly, an important object of the present invention is to provide a method for automatically doffing a strand package formed on a draw type winder having a rotating collet upon which the strand package is formed without interrupting the rotation of the winder nor the continuous production of the strand.

Still another important object of the present invention is to provide a method for automatically doffing a strand package formed on a collet of a draw type winder without interrupting the rotation of the collet and the strand production process.

Still another important object of the present invention is to provide a method for automatically doffing a strand package formed from a single continuous strand while the package is rotating.

Yet another important object of the present invention is to provide a method for automatically doffing a rotating strand package formed on a rotating collet of a collet winder wherein a rotating doffing cup is utilized to grip the rotating strand package and retract it from the rotating collet without interrupting the winding operation of the collet and continuous production of the strand.

Yet another important object of the present invention is to provide a method for automatically doffing a rotating strand package wherein a rotating doffing cup is utilized to grip the strand package while it is rotating and remove it from a rotating collet in a manner that automatically causes a trailing strand to be wound upon the empty collet to start the winding of a new strand package, all the while the winding operation of the collet and the production of the strand are continued.

SUMMARY OF THE INVENTION

A method of automatically doffing a strand package off of a rotating collet of a collet winder is provided wherein yarn being supplied to the collet from a gathering ring is wound upon the collet by a traversing guide to form a strand package. The method comprises providing a horizontal row of collet winders, each having an associated traversing guide. An automatically controlled robot machine is provided having a servo-linkage arm movable in path generally along the row of collet winders. A plurality of receiving stations for receiving a full strand package when removed from the collet winder is provided. A variable speed rotating doffing cup is carried adjacent a free end of the servolinkage arm of the robot machine which receives a rotating drive from the robot machine. An inflatable cup liner is carried around the interior circumference of the hollow doffing cup which is cylindrical in shaped. The robot machine is moved along a path in front of a full strand package to be doffed.

The doffing cup is positioned with its axis of rotation parallel and coincident with the axis of rotation of the full strand package, and is extended over the full strand package of a doff position while the doffing cup is rotated at a speed at least as great as the rotational speed of the rotating collet and strand package. The inflatable cup liner is inflated when the doffing cup is in a doff position to grip the strand package firmly around its entire circumference. The rotating doffing cup and strand package are then retracted along the axis of rotation of the doffing cup and collet to remove the strand package from the collet while the strand package is rotating with the doffing cup. In the previous doff position, the doffing cup has pushed the strand extending from the package to the collecting ring off of the package and onto the rotating collet where it has made new windings. As the package is removed axially, the strand slips further off of the package and makes further windings on the collet. At some point the strand breaks as the rotating package is pulled away. The strand coming from the collecting ring is picked up by the traversing guide, and a new package is wound therefrom.

After the strand from the rotating strand package is severed and the strand package is fully removed, the rotational speed of the rotating doffing cup and strand package is braked. The strand package is moved by the servolinkage arm to one of the receiving stations and deposited onto a carrier. The inflatable cup liner is deflated and the doffing cup is retracted leaving the package on the carrier.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
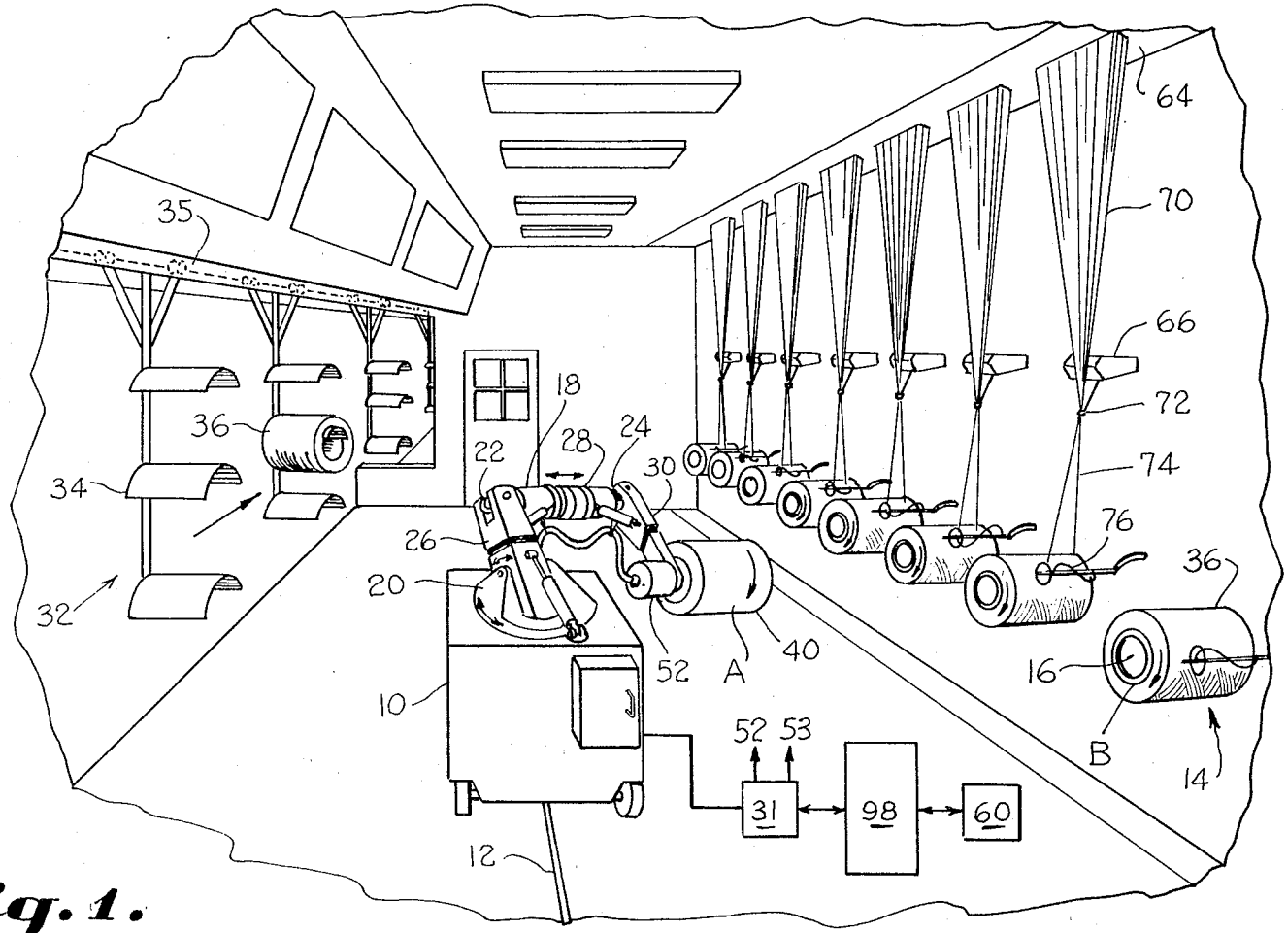
FIG. 1 is a perspective view illustrating a method for automatically doffing a rotating strand package in accordance with the present invention.

Referring now in more detail to the drawings, a method automatic for doffing a strand package while rotating is illustrated which includes a robot machine designated generally at 10 which may be a wheeled vehicle which travels down a grooved track 12 generally parallel to a horizontal row, designated generally as 14, of collet winders B. The robot machine includes a servo-linkage arm 18 which includes a shoulder joint 20, an elbow joint 22, and a wrist joint 24. Intermediate arms 26, 28, and 30 join the various joints together and provide a servo-linkage arm having six degrees of freedom. Adjacent the end of the arm 30 is a rotating doffing cup A which will be described in more detail hereinafter.

The robot machine and the servo-linkage arm 18 may be of conventional construction. Having been taught the method of automatically doffing a rotating strand package of the present invention, it would be well within the purview of average skill as an automatic process controller to provide a computer or microprocessor controller 31 and mechanism to accomplish the desired movements and positions of the doffing cup A. It is to be understood, of course, that other means for moving the doffing cup in a time sequence or other prescribed motion may be utilized.

On the opposite side of the robot machine from the row 14 of collet winders is a receiving station, designated generally as 32, which includes a number of carriers 34. Preferably, the carriers are carried on an overhead conveyor 35 and move continuously through the automatic winding and doffing room illustrated. Strand packages 36 are removed from the collet winder 16 by the automatic doffing cup A while rotating, and deposited on the carriers 34 while moving through the room while the doffing cup A is moved by the robot machine 10 and servo-arm 28.

Figure 5:
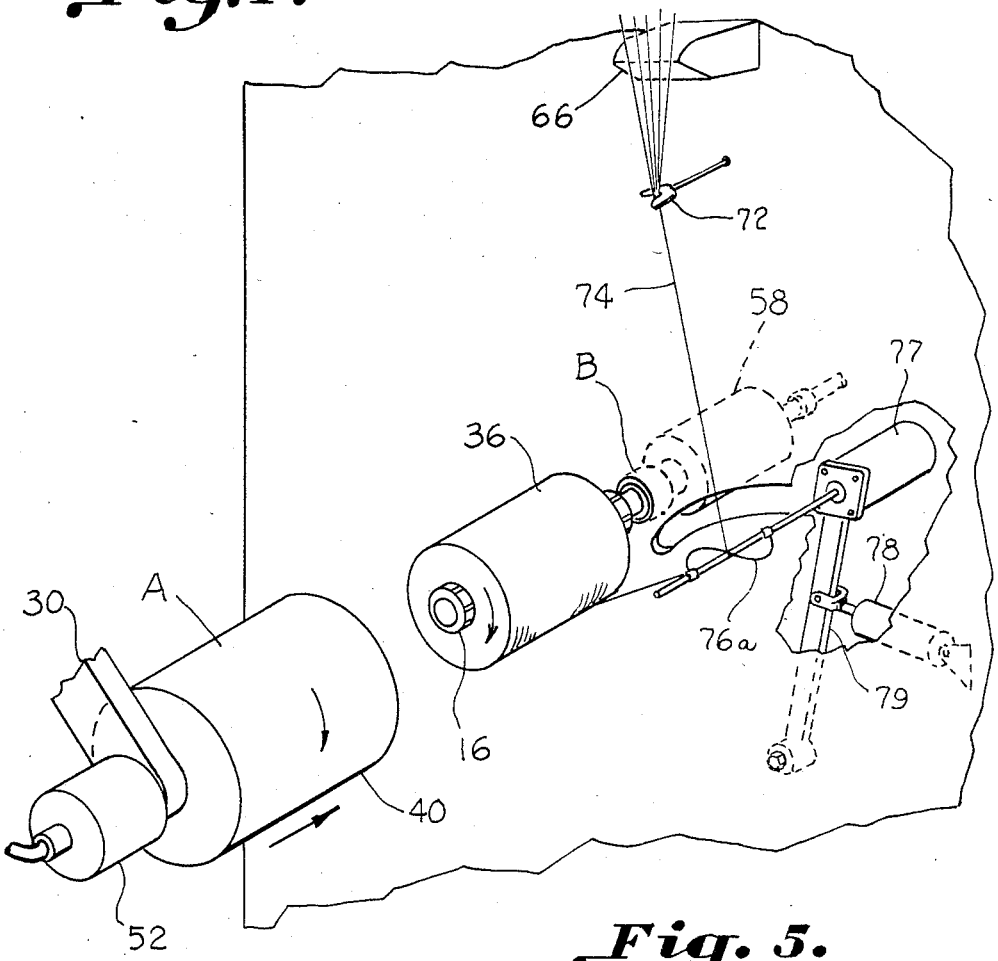
FIG. 5 is a perspective view illustrating the method and apparatus for automatically doffing a rotating strand package according to the invention.

Referring now in more detail to FIG. 5, the method will be described in accordance with a rotating doffing cup constructed for carrying out the method according to the present invention. As illustrated, the rotating doffing cup includes a hollow cup member 40 having a cylindrical interior wall 42. There is an inflatable cup liner 44 carried about the entire circumference of the cylindrical wall 42 which provides a gripping means for gripping the strand package. There is a pneumatic line 46 which communicates with the cup liner 44 through a bore **48*a* formed in a motor shaft 48 into a hub 50 of the cup member, and through a passage 50*a* to the cup liner. A suitable rotary union 51 may be utilized to connect the pneumatic line 46 and source of pneumatic pressure 20 to the shaft 48 of drive motor 52. Air pressure from a regulator valve 53 can be automatically controlled in response to the operation of the system by controller 31. Shaft 48 is rotatably journaled by bearings 48*b* in arm 30 and is affixed to cup 40**.

There is a wall unit 54 for the winding section in the room on which the row 1 of collet winders B are carried, with the collet 16 of each collet winder rotatably journaled by suitable bearings 56. The drive unit for the collet 16 is illustrated at 58 which is controlled from a remote location by a suitable programmed controller 60 which may be a conventional microprocessor as is well within the skill of an average process controller. The drive unit 58 is mounted directly to the wall by means of stud braces 62. Since the individual collet winders B are the same, the invention will be described in reference to a single collet winder B. It is to be understood that the invention may have application to any number of collet winders, but is particularly useful when doffing a number of collet winders arranged in a horizontal row as can best be seen in FIG. 1.

For purposes of illustration, the invention will be described in relation to the manufacture of strands of glass fibers. Typically, glass fibers are produced continuously by a furnace. Multiple filaments are drawn through heated bushings 64. The filaments are then passed through a binder applicator 66 where a size is placed on the filaments and collected and delivered to the winders B. The individual filaments, now shown in FIG. 1 at 70 are collected by a gathering guide at 72 and delivered generally as a strand 74 for winding upon the collet 16. A traversing guide means 76 which may be any conventional guide which distributes the strand along the length of collet 16, such as a rotary spiral wire **76*a* or a reciprocating device as shown in U.S. Pat. No. 4,206,884, is utilized to wind the strand upon the collet in a desired pattern. In this case, the collet is stationary. Alternately, the guide may be stationary and the collet reciprocated so that the strand 74** is shifted laterally back and forth along the length of the collet in the direction of the axis of rotation of the collet. The present invention may be utilized with either. In this manner, a package or cake of the strand is formed upon the collet having a suitable pattern, typically helical, as desired. A strand package having a very long continuous strand is thus formed. The helical pattern permits the strand to be withdrawn from the package without entanglement of the strand. If a reciprocating collet is utilized, then extension of the collet to meet the doffing cup in the doff position may be required in order to grip the package firmly.

The collet drive motor 58 may be air, hydraulic, or electric powered and controlled from the controller 60. The traverse guide 76 is rotated by an electrical motor 77 likewise controlled by controller 60. There is also provided an actuator mechanism 78 by which the traverse guide 76 may be brought close to the yarn package for winding of the strand thereon in the desired pattern (FIG. 5). In order the permit removal of the strand package, the yarn guide is mounted on a pivotable arm 79 which pivots to a position by movement perpendicular to the axis of rotation of the collet 16. A slot 54*a* accommodates this movement.

A conventional collet is illustrated that includes an air expandable sleeve 80 and fingers 80*a* which hold the strand windings on the collet when expanded. When deactuated, the collet diameter is decreased and the strand package easily slides off whether wound upon the collet or paperboard tube. Air from a suitable source 81 may be controlled for actuation and deactuation by controller 60. The present invention has application to either types. A suitable winder is available from the Tidland Corporation of Camas, Wash., series 650. Alternatively, the invention may be utilized with a plain spindle collet.

Figure 2:
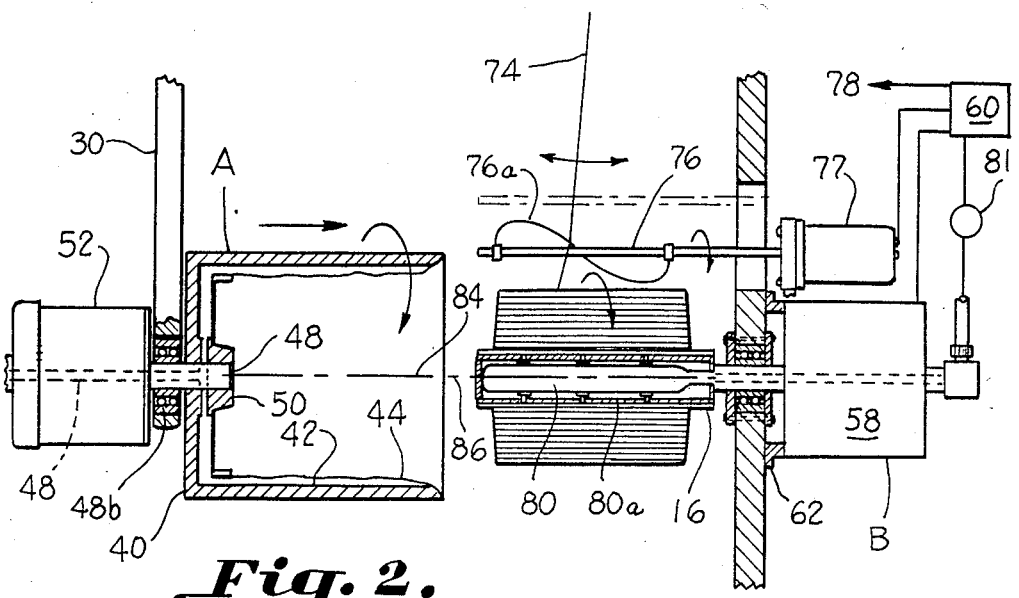
FIG. 2 is a schematic view illustrating the method for automatically doffing a rotating strand package in accordance with the present invention with a rotating doffing cup in an approach position.
Figure 3:
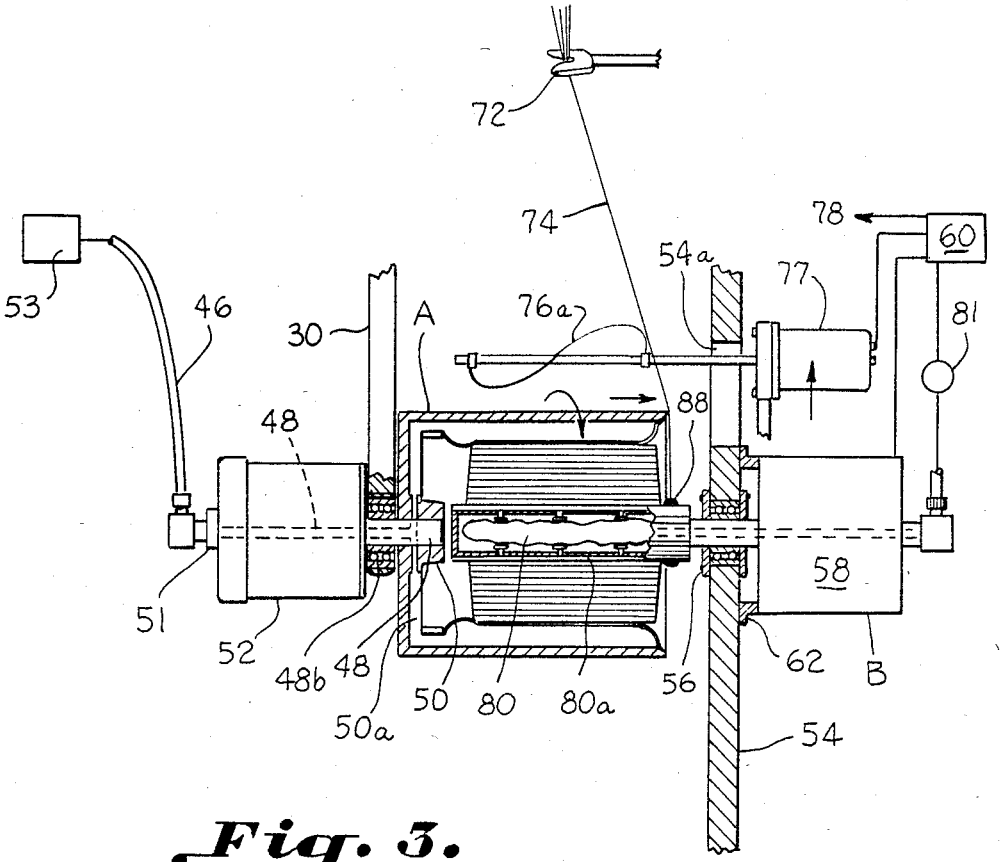
FIG. 3 is a schematic view illustrating a rotating doffing cup in accordance with the method of the present invention in a doff position wherein the rotating cup encloses substantially the entire rotating strand package.
Figure 4:
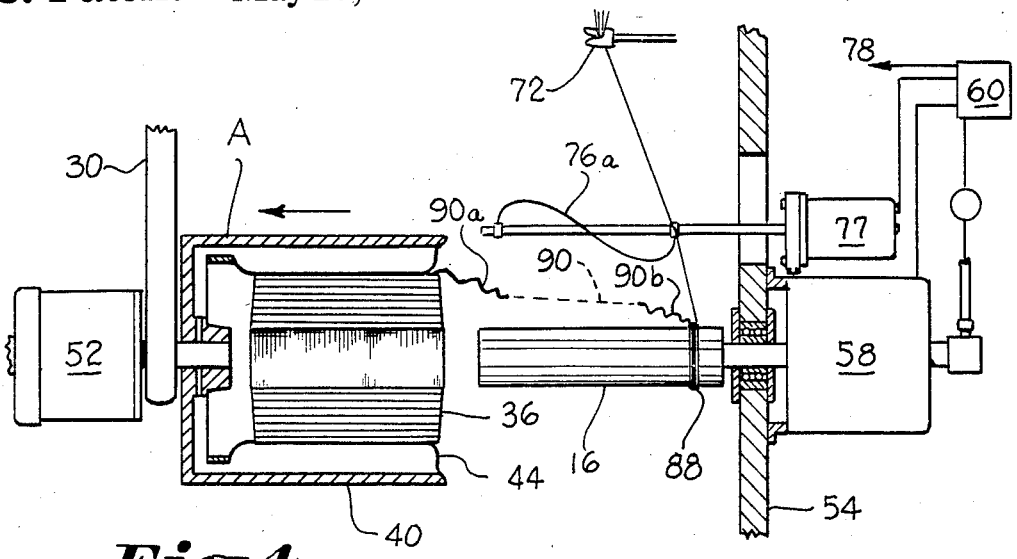
FIG. 4 is a schematic view illustrating the method of the present invention wherein a rotating doffing cup with a rotating strand package is retracted from a collet upon which the strand package has been wound.

Referring now to FIGS. 2–4, the method of the present invention will be described in detail. As the fiber strand 74 is drawn and wound onto the strand package 36, the robot doffing machine 10 moves generally parallel to the row 14 of collet winders. The rotating doffing cup A is positioned in response to control signals generated by the controller 31 and delivered to the rotating cup via the robot machine 10. Electrical contact may be had with the controller by way of a cable (not shown) carried in the guide track 12. When the strand package nears completion, as commonly referred to as "call down," the robot machine will move along the guide track 12 to a preset approach position in front of the strand package to be doffed as can best be seen in FIG. 2. In this position, the axis of rotation 84 of the doffing cup is parallel to and coincident with the axis of rotation 86 of the collet. The collet 16 and the strand package 36 are continuing to be rotated at this time. The doffing cup wil normally be stationary at this time when in the preset approach position. The doffing cup will be brought up to rotate at a speed equal to or slightly greater than that of the yarn package 36. The rotation of the doffing cup is provided by an electrical speed signal from controller 31 to the motor 52 as is well within the skill of the average artisan. The servo-linkage arm 18 will then be commanded to position the doffing cup and move it along its axis of rotation until it reaches a doff position as is illustrated in FIG. 3. prior to axial movement of the doffing cup A, the traversing guide will be pivoted or moved out of the way so that the doffing cup may be positioned over the strand package. At the doff position, the doffing cup A substantially encloses the rotating strand package 36 along most of its length. If the collet is of the reciprocating type, controller 60 will signal for the collet to be extended. In the doff position, controller 31 signals for air admission through 46 into the cup liner which is inflated to grip the strand package firmly around the entire circumference of the strand package. A time signal or a sensor may be utilized to determine arrival at doff position and doff time. The time signal may be calculated on a known winding time for full package and each collet winder B programmed by programmer 60. Either the sensor signal or time signal is sent to the controller 31.

If the collet is of an air release type, the air release mechanism in the collet will be deactuated by controller 60 which decreases the diameter of the collet and releases the package. Due to the fact that the rotating doffing cup A is rotating slightly faster than the strand package, the strand package 36 will be caused to twist relative to the collet 16 thus freeing the strand package from the collet with or without air release. This is particularly useful when an air release mechanism is not utilized in the collet.

Next, the doffing cup will be retracted along the axis of rotation pulling the strand package off of the collet 16, as can best be seen in FIG. 4. It will be noted that when the doffing cup A is moved to the doff position of FIG. 3, the cup will push the yarn strand 74 off of the end of the package onto the collet whereupon it will begin to make auxiliary windings 88 on the collet. When a full strand package is pulled off of the collet in FIG. 4, a strand 90 will extend from the doffed package 91 to the collet 16. At some point in the retraction, the strand 90 extending between tween the strand package 36 and the windings 88 on the collet 16 will normally break. In some cases it may be desirable to utilize a cutting device to positively sever the strand 90. Once the doffing cup A and strand package 36 completely clear the end of the collet 16, the traversing guide 76 will again be brought in close proximity to the collet whereupon it begins to wind 74 extending from the dropped windings 88 on the collet to the gathering ring 72. A time signal from controller 60 may be used to determine the time for guide 76 to be returned by actuator 78. The traversing guide then lays the new windings left and right over the collet in the desired helical or other pattern. The new windings will immediately overlap the end of the strand 90*a* which has been severed so that there will be no flying strand tail to produce fuzz. The severed strand trailing 90*b* from the doffed strand package 36 will be contained by the surrounding doffing cup so that the strand will not unravel and there will be no flying strand tail to produce fuzz. As soon as the doffed strand package 36 has cleared the end of the collet, the doffing cup drive motor will be braked as fast as possible without damaging the package. The servo-linkage arm 28 will then pivot and move as necessary to align the strand package axis with an empty carrier 34. The robot will be moved as is necessary to keep up with the moving carrier, or the carrier can be stopped momentarily. The yarn package is moved axially onto the carrier. The cup liner will be deflated by signaling 53 and the doffing cup will be retracted leaving the strand package 36 deposited on the carrier 34. The package is carried off on the overhead monorail 35 which transports the carriers to the next processing station. The robot machine will be moved down the track 12 to the next collet winder which is to be doffed.

It will be realized that any number of mechanisms can be utilized for moving and rotating the doffing cup A without departing from the spirit of the invention wherein a rotating hollow cup with an interior inflatable cup liner is utilized to doff a full strand package while rotating. For example, an overhead conveyor can be utilized which carries the rotating doffing cup with suitable linkage arms and drive connections and transmission for variably rotating the doffing cup at a desired speed and desired position relative to the collet winders. Preferably, the controller 31 controls the robotic motions to position the doffing cup in the approach position, the doff position, and the deposit position in a time sequence program once a certain collet winder is full. Each collet winder is timed from start to finish of a strand package and automatically doffed in response to time.

An example of a time controlled sequence of the automatic doffing cup will now be described with reference to time T being the doff time at which the air release collet is deactivated so that the strand package may be doffed from the collet. The time that a winder B, as designated by a station number, has been doffed is entered by the technician or a central process computer 98 into the winder controller 60. The central process computer 98 may control and coordinate controller 31 and 60 as is well within the skill of the average artisan. The winder station number, start time, rotational speed, slow-down speed, and previous doff time are transmitted to the robotic controller 31. The robotic controller checks periodically, for example at 1 minute intervals, to see that the winder is running on schedule with respect to speed and run time. The robotic controller 31 schedules the doff time for the correct time for each winder station depending upon the amount of time required to wind the package to a full size which can be easy calculable. After calculating the doff time T for a particular winder station, based on the previous doffing of the winder and the known winding time, the robotic doffer begins to move towards the station at T minus 30 seconds. The controller signals the doffing cup A which begins to rotate. At T minus 5 seconds, the robotic doffer is at the approach position in front of the winder. The doffing cup is in axial alignment with the collet of the winder and begins reaching the doffing rotational speed which is preferably slightly higher than the rotational speed of the collet at that time.

It will be understood that the collet will have slowed down somewhat in its winding speed since the initiation of the windings upon the collet. This is because the winder controller 60 slows down the speed of the collet as the windings build up on the collet to maintain the linear pull rate of the strand 74 constant as it is wound upon the package. For example, the collet may draw the strand at approximately 16,000 feet per minute with a starting winding speed of 5,200 rpm. To maintain this draw rate as the package is built up to a 12′ diameter package, the collet must be slowed down to 4,100 rpm at doff time.

At T minus 2 seconds the robotic controller moves the rotating doffing cup to the doff position relative to the winders. If a movable winder is utilized, the controller will move the winder; otherwise the guide will be moved. In the doff position, the doffing cup substantially encloses the entire strand package. At time T, the robotic controller signals the winder controller 60 to activate the collet air release. Simultaneously, the robotic controller activates the cup liner of the doffing cup to grip the package. Due to the rotation of the doffing cup being slightly greater than the collet, the strand package is released from the collet and twisted free. The robotic movement pulls the doffing cup and strand package towards the end of the collet, and simultaneously the robotic controller signals the winder controller to return the collet or guide to the winding position.

At T plus 2 seconds the doff package clears the end of the collet and the robotic controller 31 signals the winder controller 60 to deactivate the collet air release and accelerate back to 5200 rmp, or other operational winding speed, to being winding the new strand package. Simultaneously, the doffing robotic controller initiates deceleration and braking of the doffing cup and package. At T plus 3 seconds, the collet has reached the winding speed to begin the new winding package. The traversing guide begins to rotate and picks up the strand to distribute it along the length of the collet according to the desired pattern.

The robotic doffer begins movement to an empty carrier at T plus 3 seconds where it comes into alignment with an empty carrier, and moves along with the overhead conveyor to maintain axial alignment with the carrier while the strand package is placed on the carrier. When the package is positioned on the carrier, the robotic controller deflates the cup liner to release the package and deposit it on the carrier whereupon the doffing cup is retracted. The robotic controller then transmits the information to the central process controller 98 identifying the strand package and the conveyor or carrier station on which it was deposited. The robotic controller then schedules movement to the next winding station for doffing based on the information received from the winder which is next due to be full. The above steps are then repeated in an automatic and continuous fashion to provide automatically doffed strand packages without necessitating interruption in the continuous production of the strand.

While a preferred embodiment of the invention has been described using specific terms, such description is for illustrative purposes only, and it is to be understood that changes and variations may be made without departing from the spirit or scope of the following claims.

What is claimed is:

1. In a method of producing fiberglass strands which includes continuously producing multiple glass filaments and gathering said multiple filaments together into a single fiberglass strand, and winding said fiberglass strand upon a draw winder of the type which includes a rotating collet to form a strand package wherein the improvement comprises a method of automatically doffing said strand packages which comprises:

providing a rotating doffing cup having a hollow cylindrical interior;

providing an inflatable cup liner in said hollow interior of said doffing cup;

positioning the doffing cup in an approach position in front of a full strand package which is to be doffed so that the axis of rotation of said doffing cup is parallel to and coincident with the axis of rotation of said full fiberglass strand package;

moving said doffing cup along its axis of rotation from said approach position to a doff position where said strand package is enclosed generally entirely within the hollow interior of said doffing cup;

dropping said strand extending from said strand package to said collecting ring off of an end of said strand package onto said collet to form auxiliary windings;

inflating said inflatable cup liner of said doffing cup until said strand package is gripped around generally the entire circumference thereof by said cup liner while rotating said doffing cup at a speed at least as great as the rotational speed of said collet of said draw winder;

retracting said doffing cup and gripped strand package along said axis of rotation while rotating in a manner such that a strand extends from said doffed strand package to said auxiliary windings on the surface of said collet;

severing said strand extending from said doffed strand package and said collet of said draw winder;

braking the rotation of said rotating doffing cup with said doffed strand package being held within the interior of said doffing cup; and depositing said doffed strand package at a receiving station.

2. The method of claim 1 including overwrapping a tail of said severed strand with new windings being wound on said collet so that there will be no flying tail to produce fuzz.

3. The method of claim 1 including containing a tail of said severed strand extending from the doffed strand package by surrounding said strand package with said doffing cup so that there will be no flying tail to produce fuzz.

4. The method of claim 1 including:

positioning said braked doffing cup and doffed strand package at a receiving station;

positioning the doffed strand package on a carrier;

deflating said inflatable liner of said doffing cup to deposit said doffed strand package on said carrier; and moving said doffing cup away from said receiving station to an approach position in front of another full strand package to be doffed.

5. The method of claim 1 including:

rotating said collet continuously at an operational winding speed during the doffing of said full strand package by said doffing cup.

6. The method of claim 1 including removing said strand package from said collet by said doffing cup in such a manner that said strand extending from said auxiliary windings to said strand package is broken and said strand from said collecting ring forms windings of a new strand package automatically on said doffed strand package being moved outwardly along the axis of rotation of said collet.

7. The method of claim 1 wherein said doffing cup is brought to a rotational speed which is slightly greater than that of said rotating strand package prior to said inflatable liner being inflated and gripping said fiberglass strand package to free said strand package when gripped.

8. A method of automatically doffing a strand package off of a rotating collet of a collet winder wherein yarn is supplied to said collet from a gathering ring and wound upon said collet by a traversing guide to form a strand package, said method comprising the steps of:

providing a horizontal row of said collet winders each having a collet and an associated traversing guide;

providing a plurality of receiving stations for receiving said strand packages when doffed from said collet winders;

providing a variable speed rotating doffing cup having an inflatable cup liner expandable to grip said strand package;

moving said doffing cup along a path generally along said row of collet winders and back and forth from said collet winders and receiving stations;

positioning said doffing cup in an approach position in front of a strand package to be doffed with an axis of rotation of said doffing cup parallel and coincident with the axis of rotation of said strand package;

extending said doffing cup over said full strand package to a doff position and rotating said doffing cup at a speed generally equal to or greater than the rotational speed of said rotating collet and strand package;

inflating said inflatable cup liner of said doffing cup when said doffing cup is in said doff position to grip the strand package firmly around its circumference;

retracting said doffing cup and strand package along the axis of rotation of said doffing cup and collet to remove said strand package from said collet while said strand package is rotating with said doffing cup;

severing the strand package extending from said rotating doffed strand package to said collet;

braking said rotational speed of said rotating doffing cup and strand package after removal from said collet; and depositing said strand package at said receiving station by deflating said inflatable liner of said doffing cup after said rotation of said doffing cup has been braked.

9. The method of claim 8 including rotating said doffing cup at a speed slightly greater than the speed of said rotating collet and strand package in said doffed position prior to gripping said strand package to free said package from said collet.

10. The method of claim 8 including dropping a section of said strand extending from said strand package to said gathering ring off of the end of said rotating strand package onto the surface of the collet to begin auxiliary windings of a new strand package prior to the severing of said strand package.

11. The method of claim 10 including overwrapping a strand tail formed by severing said strand on said collet with windings forming said new strand package on said collet so that there will be not flying tail of said new strand package which produces fuzz.

12. The method of claim 10 including retaining a strand tail on said doffed strand package after severing of said strand within the interior of said doffing cup so that there will be no strand tail flying in rotation to produce fuzz.

13. The method of claim 8 including moving said traversing yarn guide perpendicular to the axis of rotation of said collet prior to said doffing cup being extended over said full strand package to said doff position; and returning said traversing guide to said traversing position after said doffing cup and strand package have been retracted and removed from said collet to commence the forming and winding of said new strand package.

14. A method of producing a continuous strand of glass fibers of the type which includes producing glass fibers continuously, collecting said glass fibers in a single strand, advancing the strand to a rotating collet, causing the strand to traverse the collet back and forth along the length of the collet to form a strand package, wherein the improvement comprises:

providing a rotating doffing cup having a hollow cylindrical interior with an actuatable gripping means carried about the circumference of said cylidrical interior;

positioning said doffing cup at a preset approach position in front of a full strand package so that the axis of rotation of the doffing cup is parallel to and coincident with the axis of rotation of the collet;

extending said doffing cup to a doff position in which the doffing cup generally encloses the strand package along generally the entire length thereof while rotating said doffing cup at a speed generally equal to the rotational speed of said full strand package;

actuating said gripping means when said doffing cup is in said doffing position so that said strand package is gripped around its entire circumference and firmly held by said doffing cup;

retracting said doffing cup and strand package along said axes of rotation causing said rotating strand package to be doffed off of said rotating collet;

producing a strand extending from said doffed strand package to said collet;

severing said strand extending from said strand package to said collet as said rotating doffing cup and strand package are retracted producing a tail strand on said strand package and a tail strand on said collet;

depositing said doffed strand package at a receiving station; and forming windings on said collet to form a new strand package without stopping rotation of said collet.

15. The method of claim 14 including overwrapping said tail strand on said collet with said new strand windings so that there will be no flying tail of yarn which produces fuzz.

16. The method of claim 14 including containing said said tail strand of glass fibers on said strand package with said doffing cup so that there is no flying tail of yarn to produce fuzz.

17. The method of claim 14 including the steps of:

braking said rotating doffing cup and doffed strand package after being retracted from said collet and said strand of glass fibers has been severed to a non-rotating speed;

positioning said braked doffing cup and full strand package at a receiver station;

depositing said full strand package on a carrier;

deactuating said gripping means; and retracting said doffing cup so that said full strand package is left at said receiving station.

18. The method of claim 14 including rotating said doffing cup at a speed slightly greater than the speed of said full strand package when in said doff position so that said full strand package is freed from said collet when gripped by said gripping means.

* * * * *